United States Patent [19]

Moore

[11] 3,944,805

[45] Mar. 16, 1976

[54] WIRELESS ELECTRIC SWIVEL HEAD HAND LANTERN

[75] Inventor: Arthur H. Moore, Fairfield, Conn.

[73] Assignee: The Bridgeport Metal Goods Manufacturing Company, Bridgeport, Conn.

[22] Filed: Jan. 24, 1975

[21] Appl. No.: 543,884

[52] U.S. Cl. ..... 240/10.61; 240/10.63; 240/10.67

[51] Int. Cl.[2] ..... F21L 1/00; F21L 15/00

[58] Field of Search ..... 240/10.61, 10.63, 10.67

[56] References Cited

UNITED STATES PATENTS

| | | | |
|---|---|---|---|
| 1,120,668 | 12/1914 | Basedow | 240/10.61 |
| 2,510,321 | 6/1950 | Sauer | 240/10.61 |
| 2,942,102 | 6/1960 | Stoutenburgh | 240/10.63 |
| 2,991,349 | 7/1961 | Garland | 240/10.63 |
| 3,116,025 | 12/1963 | Smaltz | 240/10.61 |
| 3,252,733 | 5/1966 | Moore et al. | 240/10.63 |
| 3,535,506 | 10/1970 | Moore et al. | 240/10.63 |

*Primary Examiner*—Joseph F. Peters, Jr.
*Attorney, Agent, or Firm*—Wooster, Davis & Cifelli

[57] ABSTRACT

A wireless electric swivel head hand lantern generally comprising a lantern battery, a lantern handle and a swivel head containing a lamp. Metal strips are used to connect the terminal posts of the lantern battery to the lamp in the swivel head. Electrical contact is made without the use of wires, solder, rivets or the like by positioning the metal strips so that portions of the surface areas of the strips are conjoined. Portions of the metal strips are disposed inside the swivel head and configured in such a manner that electrical contact with the lamp is automatically made and maintained by positioning the lamp in the swivel head and securing it in place.

13 Claims, 7 Drawing Figures

Fig. 4.
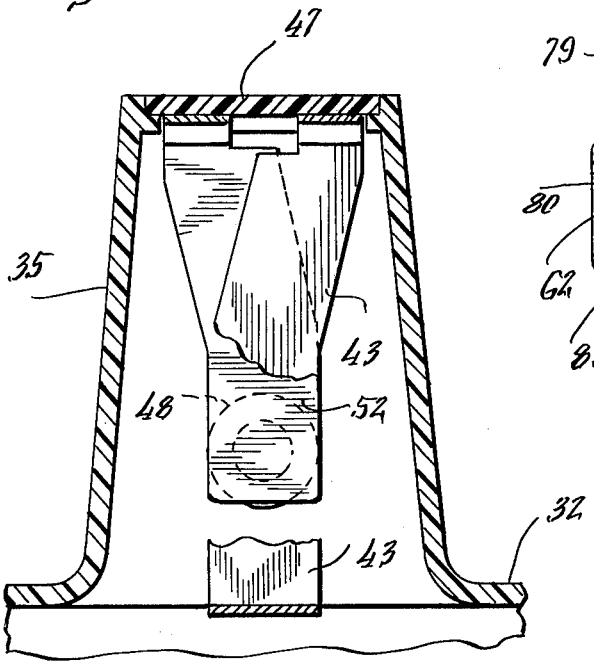
Fig. 5.
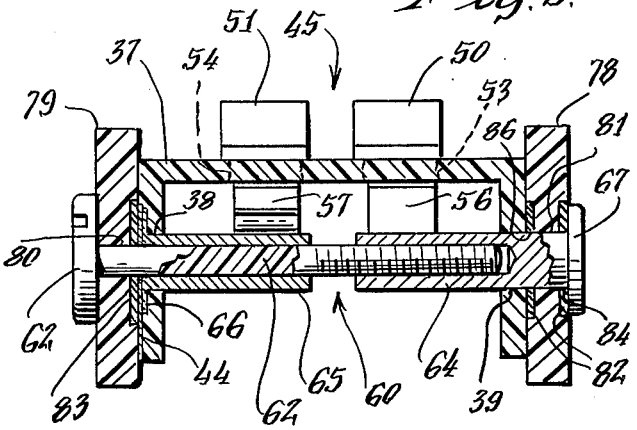
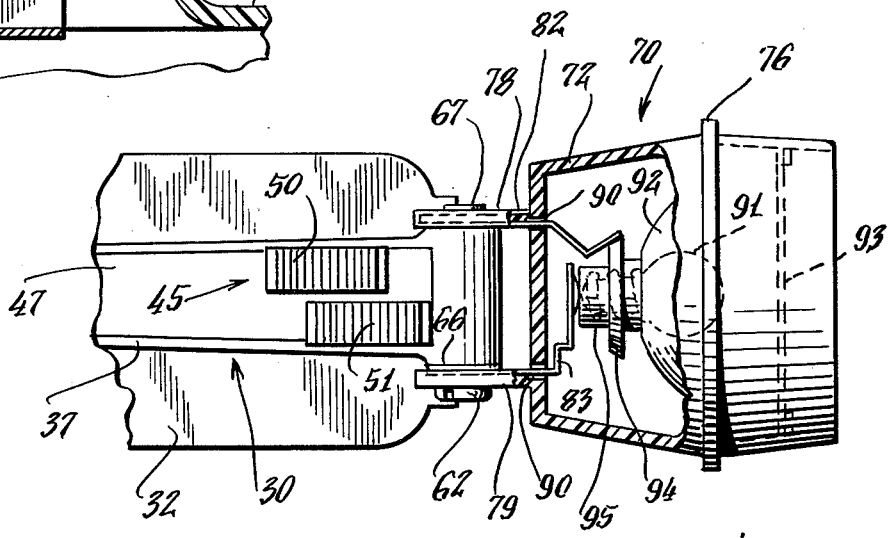
Fig. 6.
Fig. 7.
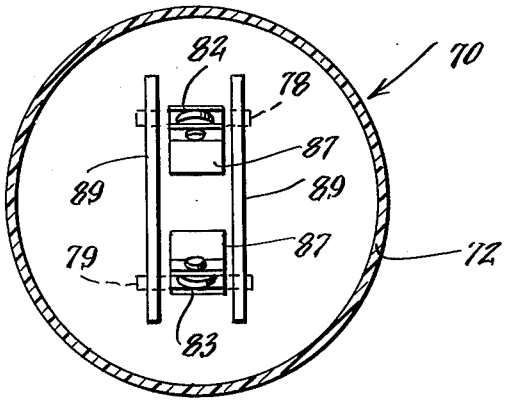

WIRELESS ELECTRIC SWIVEL HEAD HAND LANTERN

BACKGROUND OF THE INVENTION

This invention relates to an improvement in electric swivel head hand lanterns. These lanterns have been well-known for quite a number of years and are very useful, as they combine a powerful and long-lasting battery with a large lamp to produce a light source.

An electric swivel head hand lantern is generally comprised of three basic elements; a heavy duty lantern battery, a handle which fits over and attaches to the top of the battery and a swivel head which is connected to the upper portion of the front of the handle. The swivel head contains the lamp.

Although the entire lantern itself is heavy and unwieldy, primarily due to the weight of the battery, the mobility problem is overcome by the swivel head feature which permits the direction of the light beam to be changed without changing the position of the handle and the battery. This is accomplished because the swivel head can pivot about its connection point with the handle in a vertical plane. Most swivel heads are capable of directing a beam at any angle in approximately a 120 degree arc starting from a vertical position. This swivel head feature enables the operator to direct the light beam upward or downward while holding the lantern handle and attached battery in a comfortable level position and, therefore, it is unnecessary to actually point the entire lantern in the desired direction.

Furthermore, in addition to being more powerful than an ordinary flashlight, these lanterns are also much more versatile. They can be set on the ground or any relatively flat surface and the light beam positioned at the desired angle. The beam will remain properly directed while the lantern is unattended, and the operator thereby has both his hands free to do any required work in a now well-lighted area.

Because of their powerful, long-lasting beam and their versatility, these lanterns are widely used by police and fire departments. Therefore, due to the emergency nature of much of their use by these agencies, lantern reliability and durability is of prime importance. However, the dependability of existing swivel head lanterns is not great, primarily due to their extensive electrical wiring. Furthermore, the wiring creates additional problems in manufacturing these devices which substantially increases the cost of manufacturing the lantern, and thereby substantially increases the ultimate retail cost of the devices to the consumer.

A general uniformity is found in the structural arrangement and dimensions of these lanterns which is due, at least in part, to the usual method of connecting the standard lantern battery which has two screw threaded terminal posts in its top surface. The lantern handle fits over the top of the battery and the terminal posts protrude through two terminal post holes in the base of the lantern handle. Since the corresponding screw threaded terminal caps for the terminal posts are larger than the holes in the handle base, the battery becomes firmly attached to the lantern when these caps are screwed on to the protruding terminal posts and tightened. As this type of battery is a standard one in the battery industry, usually of about 6 volts, this manner of attachment permits quick and easy battery replacement, and the lanterns all employ a common type of power source.

This arrangement, however, has created an inherent problem in prior lanterns, as the terminal post holes in the lantern handle must be wired to make contact with the battery posts. This usually requires wiring a metal contact ring for the post hole. If the handle is metallic, as it often is, a nonconductive washer must surround the contact ring to insulate the ring from the handle and prevent the battery from being shorted out. This insulating washer must be riveted to the handle.

The wiring from the battery post contacts are then run up to the crosspiece of the lantern handle where the switches are usually located. Most swivel head lantern switches are of the slide type which use movable strips of metal to open and close contacts. The wiring from the battery post contacts must be riveted, soldered or crimped inside the crosspiece of the handle to the metal slides of the switch.

In order to provide electrical power to the lamp in the swivel head, additional wires must also be attached inside the handle to the switch contacts and run from the switches to the swivel head. As most of these types of lanterns are designed to permit as much freedom of movement for the swivel head as possible, there is usually a gap between the handle and the swivel head so the handle will not restrict the swing of the swivel head. Thus, these electrical wires from the switch in the handle must be run across this open space and are, therefore, exposed. When these wires are inside the swivel head they are usually crimped with a type of terminal ending, such as a slotted eye bolt, which can be attached to and removed from the lamp.

In addition to this fundamental wiring, most lanterns have a secondary red flasher light at the end of the handle opposite the swivel head which also requires the wiring of a separate switch in the same manner as previously described.

Because of this fairly extensive wiring, manufacture of these prior lanterns is expensive, as machine operations, such as riveting, and time consuming manual operations, such as hand wiring, soldering, wire crimping and sleeving must be performed, all of which combine to raise the cost of manufacture substantially.

In addition, these manufacturing expenses are further increased because of removable wiring connections required in the swivel head. Swivel head lanterns generally use one of two types of lamps; either a single bulb and reflector or a sealed beam lamp. If a bulb and reflector are used, the wires inside the swivel head which come from the handle and the battery must be manually connected to the outer casing of the bulb and the base of the bulb respectively. If a sealed beam lamp is used, one of these wires must be manually connected to each of the two contact bars on the base of the lamp. At this point, the bulb and reflector or the sealed beam lamp must be balanced on the lip of the swivel head bowl while a retaining ring or other device is attached which holds the connected lamp assembly in place. This operation is time consuming and only done with a good deal of difficulty. Furthermore, the lantern owner must repeat this operation whenever the bulb or lamp needs replacement.

In addition, because of this prior manner of lamp attachment, there is always an inherent possibility of a disconnected wire or at least poor electrical contact inside the swivel head itself every time a lamp is installed. Most known lamps are produced with only a small raised bump at one point on the back edge of the lamp. Since there is usually only a minor indentation, if any at all, in the lip of the swivel head bowl to seat the raised bump on the lamp, the lamp has a great tendency to rotate as the retaining collar is screwed on. The rotation of the lamp will cause a corresponding rotation in the wires inside the swivel head bowl which are attached to the lamp, and the twisting of these wires may loosen or break the electrical connections.

Besides being expensive to manufacture, the prior swivel head lanterns have another major drawback. As with any piece of electrical equipment, the wiring and wiring connections are likely to loosen or break completely with any type of rough use, and these lanterns are often given the severest type of treatment, particularly in an emergency situation when dependability is of paramount importance. Furthermore, those lantern wires which are exposed between the swivel head and the handle are particularly susceptible to breakage, as they are often under stress and likely to be stretched or pinched when the swivel head is moved.

Nevertheless, despite the high cost, and lack of reliability, these lanterns are popular and widely used.

SUMMARY OF THE INVENTION

An improved electric swivel head hand lantern according to the invention herein is more dependable and much less expensive to manufacture than prior art lanterns. In addition, it is also much easier to replace the lamp in the improved lantern. The improved lantern comprises a heavy duty lantern battery, a handle of nonconductive material which fits over and attaches to the top of the battery and a swivel head of nonconductive material wherein all of the electrical connections in the handle and swivel head are made with metal strips.

In one embodiment of the invention, one end of metal strip contacts the rear battery terminal post at the terminal post hole which is located in the usual position in the base of the handle. This metal strip runs to the top of the lantern handle where the switch is positioned. The switch is of a standard slide type which employs a switch button attached to a metal slide which combination can move a short distance forward and backward. The metal slide is always in contact with the metal strip from the rear battery terminal.

With this invention, when the switch button and the metal slide are moved forward the slide will make contact with the surface of a metal cylinder mounted on the screw which holds the swivel head to the lantern handle. The metal cylinder contacts another metal strip which is run to the swivel head, thereby completing the circuit from the rear terminal post to the swivel head when the switch button is pushed forward.

The remainder of the circuit to the swivel head is completed by attaching the end of another metal strip to the front battery post terminal in the same manner as previously described and running this metal strip to another metal cylinder mounted on the other side of the screw holding the swivel head to the lantern handle. Since opposite battery terminals are connected to opposite cylinders mounted on the same screw, the screw must be made of nonconductive or insulated material or else the battery would be shorted out. This cylinder contacts another metal strip which is run to the swivel head. Both metal strips which run to the swivel head are attached to the inside of the swivel head prongs which protrude from the outside bottom of the swivel head bowl and are positioned outside the front of the handle to which they are connected by the previously described screw. The electrical contact is always maintained regardless of the position of the swivel head, but these metal strips carrying current from the handle to the swivel head are not stretched and, therefore, are not subjected to the stresses encountered by the exposed wiring as found in the prior art.

Two types of lamps are used with the swivel head lantern, a sealed beam lamp and a bulb and reflector. This sealed beam lamp is the most common and has two separate contact bars at its base which are connected internally to opposite sides of the bulb filament. In order to mount the sealed beam lamp inside the swivel head of this invention, one embodiment has two retaining walls positioned on the bottom of the inside of the swivel head bowl. The two metal strips from the cylinders protrude through the bottom of the swivel head between these walls. The portion of the two metal strips which protrude are bent outwardly. The contact bars on the base of a sealed beam lamp fit between the retaining walls, and the lamp is, therefore, automatically seated in the swivel head and cannot turn. At the same time, each of the contact bars on the lamp comes in contact with one of the two metal strips between the walls. With this invention the lamp connection is automatically made when the lamp is seated in the swivel head, and lamp replacement is simple and does not involve manually attaching two separate wires to the lamp, as with prior art lanterns. The other type of lamp, the bulb and reflector, is similar to the arrangement found in a common flashlight wherein one side of the bulb filament is connected to the base of the bulb and the other is connected to the bulb casing. In another embodiment of this invention, this type of lamp can also be automatically connected in the swivel head. The metal strips are bent slightly so that one contacts the base of the bulb and the other contacts the bulb case when the lamp is in place. No retaining walls are needed since both contacts will be maintained regardless of the rotational position of this lamp.

Since all of the metal strips can be snap fitted into a premolded lantern handle and swivel head, this invention eliminates the need for the expensive and time consuming manufacturing operations, such as riveting, soldering, crimping, sleeving and hand wiring.

Accordingly, a principal object of the present invention is to provide an electric swivel head hand lantern which is more economical to manufacture than the known electric swivel head hand lantern.

Another object of the present invention is to provide an electric swivel head hand lantern which is more reliable than the known electric swivel head hand lanterns.

Another object of the present invention is to provide an electric swivel head hand lantern whose lamp can be easily replaced.

Other and more specific objects of the invention will be in part obvious and will in part appear from the following description of the preferred embodiments and claims taken together with the drawings.

DRAWINGS

FIG. 4 is a cross-sectional view of the back portion of the lantern handle taken along lines 4 — 4 of FIG. 3;

FIG. 5 is a cross-sectional view of the upper portion of the front of the lantern handle taken along lines 5—5 of FIG. 3;

FIG. 6 is a top view of a portion of the lantern handle and a partial cutaway view of the swivel head with a mounted bulb and reflector; and FIG. 7 is a cross-sectional view of the swivel head taken along lines 7—7 of FIG. 2.

The same reference numbers refer to the same elements throughout the various figures.

DESCRIPTION OF THE PREFERRED EMBODIMENTS

Figure 1:
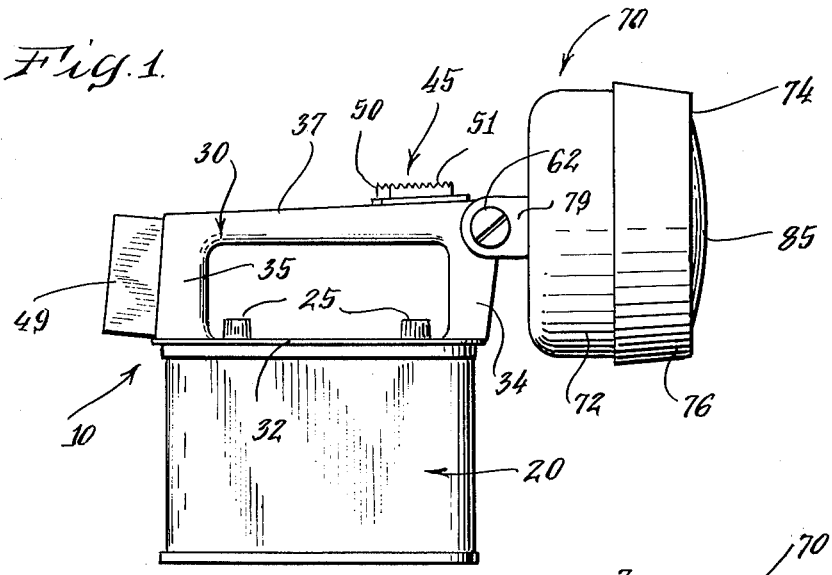
FIG. 1 is a side view of the entire electric swivel head hand lantern complete with lantern battery.

Referring now to FIG. 1, an electric swivel head hand lantern according to the invention herein is shown at 10. The lantern 10 generally comprises three main elements which are a lantern battery 20, a lantern handle 30 and a swivel head 70.

Figure 3:
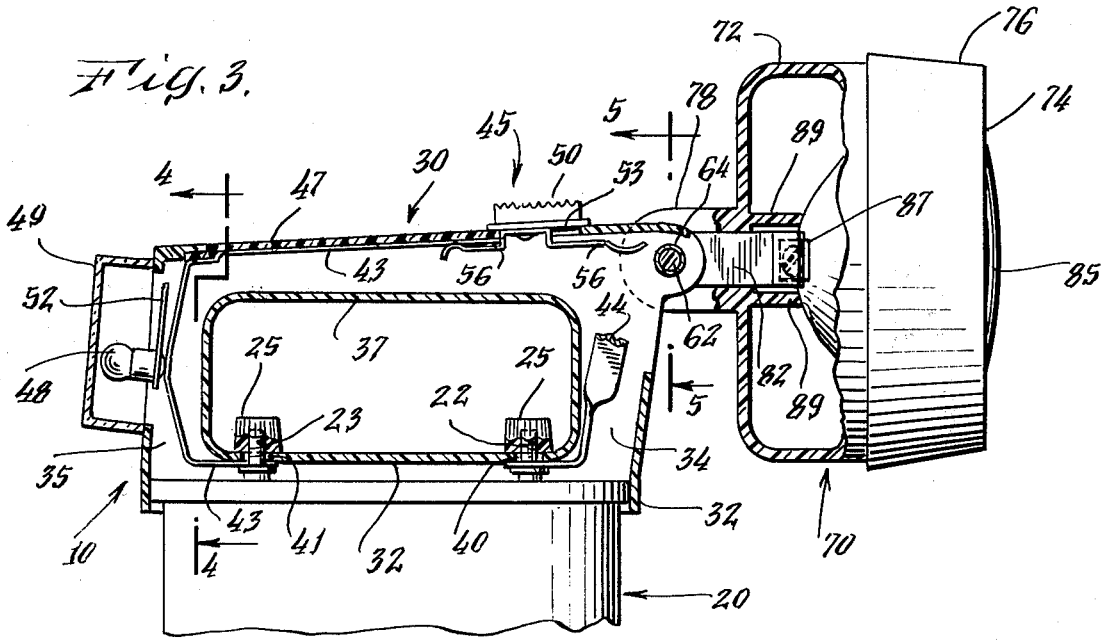
FIG. 3 is a cross-sectional view of a lantern handle taken along lines 3—3 of FIG. 2.

The lantern battery 20 is a well-known and standard size battery, usually of 6 volts. As shown in FIG. 3, the lantern battery 20 has a front terminal post 22 and a rear terminal post 23 which are both located in the top surface of the lantern battery 20. Each terminal post 22, 23 is screw threaded and fitted with a cap 25 which is correspondingly screw threaded.

The lantern handle 30 of this invention is made of a nonconductive material and is generally comprised of a base 32, a front support post 34 and a rear support post 35, both mounted on opposite ends of the base 32, and a crosspiece 37 connecting the tops of the support posts 34, 35. It is the crosspiece 37 which is gripped by the lantern operator. Both the crosspiece 37 and the support posts 34, 35 are hollow in this embodiment.

As shown in FIG. 3, the base 32 has a front terminal post hole 40 and a rear terminal post hole 41. The lantern handle 30 fits over the top of the lantern battery 20 and the two terminal posts 22, 23, protrude through the two respective terminal post holes 40, 41 in the base 32 of the lantern handle 30. The caps 25 are then screwed on to the portions of the terminal posts 22, 23 extending above the base 32. As the caps 25 are of a larger diameter than the terminal post holes 40, 41, the lantern handle 30 is securely fastened to the lantern battery 20 when the caps 25 are attached to the protruding terminal posts 22, 23.

Referring again to FIG. 3, a metal strip 43 is located inside the rear of the lantern handle 30. One end of the metal strip 43 is attached to the underside of the base 32 so that the metal strip 43 makes electrical contact with the rear terminal post 23 of the lantern battery 20 when the lantern battery 20 is connected to the lantern handle 30 as previously described. The metal strip 43 is run up inside the rear support post 35 to the inside of the crosspiece 37 of the lantern handle 30.

Figure 2:
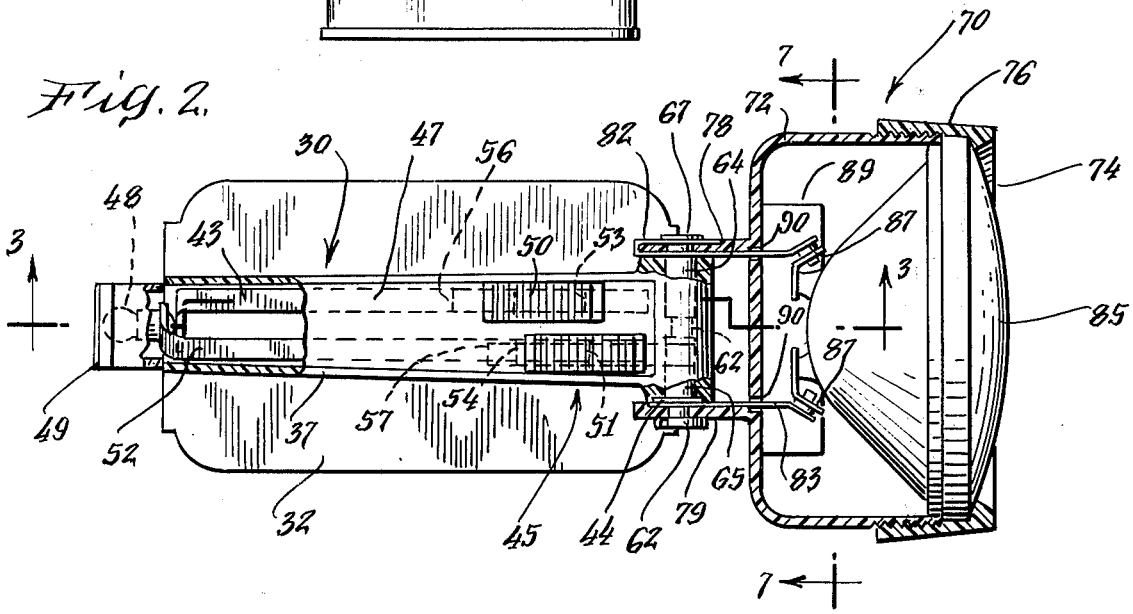
FIG. 2 is a top view of the lantern showing a cutaway view of a portion of the top of the handle and the swivel head with a mounted sealed beam lamp.

As shown in FIG. 2, a switch assembly 45 is located on the top of the hollow crosspiece 37 of the lantern handle 30. The switch assembly 45 is generally comprised of a mounting plate 47, a lamp switch button 50 and a flasher switch button 51. The mounting plate 47 in this embodiment is nonconductive and comprises nearly the entire top surface of the crosspiece 37. The mounting plate 47 has a left slot 53 and a right slot 54 positioned at a location near the front of the mounting plate 47.

The lamp switch button 50 is positioned on the top of the mounting plate 47 over the left slot 53. On the underside of the mounting plate 47, a metal slide 56 is attached through the left slot 53 to a portion of the underside of the lamp switch button 50 which is exposed by the left slot 53. The metal slide extends adjacent the underside of the mounting plate 47 a short distance to the front and rear of the left slot 53. In this manner, the lamp switch button 50 is held in place in the switch assembly 45, as neither the metal slide 56 nor the lamp switch button 50 itself can pass through the slot 53.

As the metal slide 56 is only connected to a portion of the lamp switch button 50 exposed through the slot 53, as shown in FIG. 3, the lamp switch button 50 and the attached metal slide 56 can move a short distance forward and backward in the slot 53. The flasher switch button 51 is attached to a metal slide 57 through the right slot 54 in the same manner, and operates in the same manner. In FIG. 2 and throughout the drawings, the lamp switch button 50 is shown in the rear or "off" position, while the flasher switch button 51 is shown in the forward or "on" position.

The completed switch assembly 45 can be easily fabricated separately from the rest of the lantern, and the entire switch assembly 45 simply snapped into place on top of the hollow crosspiece 37 of the lantern handle 30.

As shown in FIGS. 2 and 3, the metal strip 43 from inside the rear support post 35 is shaped so that it runs into the crosspiece 37 and is positioned along the underside of the mounting plate 47 for much of its length. As shown in FIG. 3, inside the crosspiece 37, the metal strip 43 is positioned in contact with the metal slide 56 attached to the lamp switch button 50. The metal slide 56 is always in contact with the metal strip 43 regardless of the position of the lamp switch button 50. Therefore, when the lantern battery 20 is in place, the electric circuit is complete from the rear terminal post 23 of the battery 20 to the metal slide 56 of the lamp switch button 50.

With prior art lanterns, the switch button and the metal slide would move between two additional fixed metal strips riveted to the handle and it would be necessary to rivet, solder or crimp wires to the fixed metal strips to complete the circuit. However, the present invention eliminates the need for such additional parts and expensive operations. As the metal strip 43 from the rear terminal post hole 41 is merely placed over and in contact with a portion of the rear of metal slide 56, it thereby eliminates the need for installing a fixed strip of metal and attaching the wire from the battery terminal to it.

A pivot pin assembly 60, as shown frontally in FIG. 5, connects the swivel head 70 to the front of the crosspiece 37. The swivel head 70 which is made of a nonconductive material generally comprises a bowl 72, a lamp 74 held in place in the bowl 72 by a retaining ring 76, as shown in FIG. 1. The swivel head 70 has a left prong 78 and a right prong 79 which protrude from the bottom of the outside of the bowl 72, as shown in FIG. 2. The prongs 78, 79 are positioned parallel to each other and far enough apart so as to just fit outside of the sides of the crosspiece 37, as can be seen in FIGS. 2 and 5. It is also possible to attach one or both prongs to the inside of the lantern handle, but the movement of the swivel head may be restricted by this arrangement.

As shown in FIG. 2, the right prong 79 has a metal strip 83 attached to its inside surface and extending for most of the length of the prong 79. This metal strip 83 terminates inside the swivel head 70. The left prong 78 also has a metal strip 82 which is similarly attached to the inside of the left prong 78. One end of this metal strip 82 is folded around the bottom of the left prong and run along the outside of the left prong 78 to about the midpoint of the left prong 78.

Referring now to FIG. 5, the pivot pin assembly is shown to comprise generally an insulated screw 62, and a hollow lamp cylinder 64 and a hollow flasher cylinder 65 both of which are mounted on the insulating screw 62. The flasher cylinder 65 has a flange 66. When the flasher cylinder, which is made of metal, is inserted in a hole 38 in a side of the front of the crosspiece 37, the metal flange 66 of the flasher cylinder 65 is positioned adjacent the outside surface of the side of the crosspiece 37, while the remainder of the cylinder 65 is located inside the hollow crosspiece 37. When the prongs 78, 79 are positioned over the sides of the crosspiece 37, the metal strip 83 on the inside surface of the right prong 79 contacts the flange 66. The insulated screw 62 is inserted through a hole 80 in the right prong 79 and through the flasher cylinder 65.

The lamp cylinder 64 is also metal and has a head 67. The lamp cylinder 64 is passed through a hole 84 in the end of the metal strip 82 which is outside the left prong 78, and also through a hole 81 in the left prong 78 and a hole 86 in the metal strip 82 inside the left prong 78, and a hole 39 in the side of the crosspiece 37. The inside of the lamp cylinder 64 is screw threaded to receive the nonconductive insulated screw 62. When the insulated screw is tightened, the swivel head 70 is swivelly connected to the lantern handle 30 in a friction fit which permits adjustment of the swivel head to any desired position, but also automatically retains the swivel head in such position because of the friction fit.

When the switch button 50 is pushed forward, the metal slide 56 contacts the lamp cylinder 64. Since the head 67 of the lamp cylinder 64 contacts the metal strip 82 attached to the left prong 78, the electrical circuit is complete from the rear battery terminal 23 to inside the swivel head 70.

This arrangement provides a further improvement over the prior art, as it further eliminates the need for a second fixed metal strip, as found in the switch assembly of prior art lanterns. The second fixed strip would be riveted to the handle and contacted by the metal slide when the switch button is pushed forward. A wire would have to be soldered, riveted or otherwise attached to this fixed strip and run across the open gap and into the swivel head. By employing the lamp cylinder 64, the metal strip 82 and the prong 78 as part of the existing pivot pin assembly, the second fixed metal strip and wire are no longer necessary and the inherent mechanical and manual operations involved in connecting it are eliminated.

The total circuit to the swivel head 70 is completed by a metal strip 44, as shown in FIG. 5. One end of this metal strip 44 is attached to the underside of the base 32 so that the metal strip 44 makes electrical contact with the front terminal post 22 of the lantern battery 20 when the lantern battery 20 is connected to the lantern handle 30, as previously described.

As shown in FIG. 3, the metal strip 44 is run up inside the front support post 34 to the pivot pin assembly 60 where, as shown in FIG. 5, the other end of the metal strip 44 contacts the metal strip 83 on the right prong 79 between the prong 79 and the side of the crosspiece 37. The electrical circuit from the front terminal post 22 of the battery 20 is complete to the swivel head 70.

As shown in FIG. 2, a flasher switch button 51 is located adjacent the lamp switch button 50 on the top of the mounting plate 47. The flasher switch button 51 controls a flasher bulb 48 in the rear of the handle which is a standard item found on many of these lanterns. The flasher bulb 48 is covered by a red plastic flasher bulb cover 49. As shown in FIG. 3, the base of the flasher bulb 48, which is internally connected to one side of the bulb filament, is always in contact with the metal strip 43 from the rear battery terminal 23. A metal strip 52 contacts the bulb case which is connected internally in the bulb to the other side of the filament and is run to the inside of the crosspiece 37 and is positioned along the underside of the mounting plate 47 where it contacts the rear portion of the metal slide 57 which is attached to the underside of the flasher switch button 51 through the right slot 54. As shown in FIG. 4, the metal strip 43 from the rear battery terminal 23 and the metal strip 52 to the bulb case are positioned apart from each other and run on separate sides of the underside of the mounting plate 47. When the flasher switch button 51 is pushed forward, the front portion of the metal slide 57 contacts the flasher cylinder 65 mounted on the insulating screw 62 in the pivot pin assembly 60. The circuit to the flasher bulb 48 is complete since the front terminal post 22 of the lantern battery 20 is connected to the flasher cylinder 65 by means of the metal strip 44. Therefore, the base of the bulb is connected to one battery terminal post and the bulb case is connected to the other terminal post causing a current flow through the filament of the flasher bulb 48.

In addition to eliminating the need for the standard fixed metal strips and wires found in the switch assemblies of prior art lanterns and the inherent machine and manual operations involved in connecting them, the invention has a further benefit in this area. The electrical contact of the switch assembly of this invention is much better than in the switch assembly of prior art lanterns, as the metal strips, metal slides and cylinders have a much greater area of surface contact than the wire and metal strip combination of the prior art. Therefore, there is much less likelihood of a faulty or intermittent switch connection with this invention.

Two types of lamps are generally used with the swivel head lanterns. The most common lamp is a sealed beam lamp 85, as shown in FIG. 2. The sealed beam lamp 85 has two contact bars 87 on its base. Each contact bar 87 is connected internally to opposite sides of the filament. Thus, when each of the contact bars 87 is connected to different terminal posts of a battery, a current flow is created through the filament causing it to glow.

In order to connect the sealed beam lamp 85 inside the bowl 72 of the swivel head 70, two projecting retaining walls 89 are formed on the inside bottom of the bowl 72, as shown in FIG. 7. The retaining walls 89 are parallel and extend across almost the entire bottom of the bowl 72.

The parallel retaining walls 89 are positioned so that they extend in planes that are at right angles to the planes of the prongs 78, 79, which are located on the other side of the bowl 72, as can be seen in FIG. 7. Two slots 90 are located in the bottom of the bowl 72 between the retaining walls 89 at right angles to them.

The slots 90 are positioned just to the inside of the prongs 78, 79. The two metal strips 82, 83 which are attached to the inside of the prongs 78, 79 pass through slots in the bottom of the bowl 72 and protrude between the retaining walls 89. There, these metal strips are bent outward slightly.

The sealed beam lamp 85 fits into the bowl 72, and the contact bars 87 fit between the retaining walls 89 thereby positioning the sealed beam lamp 85 in the bowl 72 of the swivel head 70. When the sealed beam lamp 85 is in position in the bowl 72, each of the two metal strips 82, 83 contacts a different contact bar 87, as shown in FIG. 2. The sealed beam lamp 85 cannot fit into the bowl 72 unless the contact bars 87 are between the retaining walls 89. The electrical circuit is therefore completed by merely positioning the lamp in the swivel head. The retaining ring 76 is then secured around the lip of the bowl 72 and the lamp is held in place.

Another type of lamp used with the swivel head lantern is a combination of a bulb 91 and a reflector 92, as shown in FIG. 6. This arrangement is similar to one commonly found in most flashlights, as shown in FIG. 6. The bulb 91 is seated inside the narrow end of the conical reflector 92 whose larger opening is covered with a lens 93. The casing of the bulb protrudes outside the reflector 92 where an annular collar 94 which is conductive is attached to the casing of the bulb 91, and a retainer 95 is attached to the end of the casing to hold the annular collar 94 in place and also hold the bulb 91 in the reflector 92. Electrical contact with the base of the bulb 91 can be achieved through the retainer. The electrical circuit through the bulb filament is completed by connecting one terminal of the battery to the base of the bulb and the other terminal to the bulb casing or the annular collar 94.

Another embodiment of this invention for connecting such a lamp is shown in FIG. 6. The metal strip 83 from the right prong 79 is bent over so that it will contact the base of the bulb 91. The other metal strip 82 is bent so it will contact the annular collar 94 when the bulb 91 and reflector 92 are in place. As previously described, the retaining ring 76 is then attached thereby holding this lamp in place in the bowl 72.

No retaining walls are used in this embodiment since unlike the case with the sealed beam lamp, contact is obtained regardless of the rotational position of the lamp. Nevertheless, retaining walls could be used with this embodiment, but it would increase costs.

The metal strips used in this invention are generally about 1/16 inch thick. All the metal strips are about ½ inch wide, except for the metal slides in the switch assembly and the metal strips which contact with these metal slides. Because of the lack of space inside the crosspiece 37, these parts are approximately ¼ inch wide.

These dimensions can be changed. However, a wider strip would use more metal thereby increasing the expense, and a narrower strip, while being less costly, would have the drawback of providing a lesser amount of surface area for electrical contact which would reduce the reliability to some degree.

The thickness could be increased, but this would also raise costs by requiring more metal and creating manufacturing problems, as the metal strips would be less pliable and, therefore, more difficult to bend into place. A thinner strip would reduce reliability as it would be more susceptible to breakage, especially at the stress points in the bends and elbows.

The handle and the swivel head are both made of a nonconductive material because the metal strips carrying the current are unshielded and in contact with the handle and the swivel head. If these parts were conductive, the metal strips from each battery terminal would be in electrical contact through these parts and the battery would be shorted out. High impact plastic is one suitable material for the handle and swivel head. Although the metal strips could be shielded, and the handle and swivel head made of metal, this shielding would substantially increase costs.

Other wiring arrangements are possible for the swivel head hand lantern utilizing the invention as disclosed herein. For example, the metal strips can be run outside the handle. It is also possible to run the metal strips outside the prongs instead of inside, but the metal strips are more protected when run on the inside. Also, as shown in this invention, the metal strip 44 is connected between the crosspiece 37 and the right prong 79. This provides a secure contact, but this metal strip 44 could also be attached to the flasher cylinder 65 itself on the inside of the crosspiece 37. The switches could also be reversed or positioned elsewhere. Other types of switches could be used, such as a push button switch, but this and other switches are generally more costly than the slide type switch, particularly as described herein.

It also makes no difference which of the battery terminals, positive or negative, is connected to the front or rear terminal holes as all of the lamps and bulbs are responsive merely to any current flow, and polarity reversal only effects the direction of current flow.

Manufacture of this improved lantern is quicker and less costly than other known lanterns. Construction consists entirely of fitting the prefabricated parts together. No expensive machine operations, such as riveting are necessary. Furthermore, no time consuming hand operations, such as wiring, soldering, crimping or sleeving are required. Therefore, the easy hand assembly of this invention reduces fabrication time 30 to 40 percent and thereby substantially reduces the costs.

In addition, since there are no solder joints or crimp connections, reliability is enhanced. Electrical contact is also improved, as the area of surface contact between two metal strips is much greater than with two wires or a wire and a strip. Further, this invention has no exposed wires between the prongs from the swivel head which are likely to be stretched, pinched or broken.

Finally, this invention provides a means for easily replacing the lamp in the swivel head. Unlike previous lanterns which require individual connection of the wires to the lamp, the electrical connections with the lamp are automatically made upon seating the lamp and securing the retaining ring.

From the foregoing description of the invention and the discussion of prior art swivel head hand lanterns, the numerous advantages and improvements incident to the invention will now be apparent to those skilled in the art.

Accordingly, the above description of the invention is to be construed as illustrative only, rather than limiting. This invention is limited only by the scope of the following claims.

I claim:

1. In an improved electrical swivel head hand lantern having a lantern battery, a lantern handle of nonconductive material arranged to be detachably secured to said lantern battery, means for detachably securing said lantern handle to said lantern battery, a swivel head of nonconductive material swivelly secured to said lantern handle, means for swivelly securing said swivel head to said lantern handle, a lamp supported by said swivel head so as to direct a light beam from said swivel head, means for electrically connecting said lamp to said lantern battery, and a switch means for selectively breaking the electrical connection from said lantern battery to said lamp, the improvement comprising said electrically connecting means consisting entirely of a plurality of conjoined metal strips.

2. An improved electrical swivel head hand lantern as defined in claim 1 wherein said swivel head is comprised of a bowl into which said lamp may be fitted, said bowl having a pair of prongs attached to its back and extending outwardly therefrom, said prongs being positioned parallel to, axially aligned with, and separate from each other.

3. An improved electrical swivel head hand lantern as defined in claim 2 wherein said prongs are located equidistant from the midpoint of the back of said bowl and are separated from each other by a distance greater than the width of the portion of said lantern handle to which they are connected.

4. An improved electrical swivel head hand lantern as defined in claim 2 wherein said lamp is a sealed beam lamp having a pair of contact bars on its base, each of which is connected internally in said lamp to opposite sides of a filament which illuminates when an electric current flows through it.

5. In an improved electrical swivel head hand lantern having a lantern handle, a swivel head of nonconductive material swivelly secured to said lantern handle, said swivel head being comprised of a bowl into which a sealed beam lamp may be fitted so as to direct a light beam outwardly from said swivel head, means for swivelly securing said swivel head to said lantern handle comprising a pair of prongs attached to the back of said bowl and extending outwardly therefrom, said prongs being positioned parallel to, axially aligned with, and separate from each other, said sealed beam lamp having a pair of contact bars on its base, each of which is internally connected to opposite sides of a filament which glows when current flows through it, the improvement comprising means for electrically connecting said lamp inside said swivel head including a pair of retaining walls mounted on the inside bottom of said bowl of said swivel head and extending upwardly therefrom, said retaining walls being positioned parallel to each other and equidistant from the midpoint of the bottom of said bowl, separated from each other by a distance greater than the width of said pair of contact bars on the base of said sealed beam lamp, and extending above said contact bars when said lamp is positioned in said bowl, and a pair of metal strips located between said retaining walls, each of said metal strips contacting one of said contact bars when said lamp is positioned in said bowl.

6. An improved electrical swivel head hand lantern as defined in claim 5 wherein said retaining walls are aligned parallel to the horizontal axis of said bowl.

7. An improved electrical swivel head hand lantern as defined in claim 5 wherein a portion of each of said metal strips is located outside of said bowl where each of the portions of said strips is attached to the side of one of said prongs.

8. An improved electrical swivel head hand lantern as defined in claim 2 wherein said lamp is a combination of a bulb and reflector, said bulb having a base and a casing each of which is connected to opposite sides of a filament in said bulb, said bulb being outwardly directed and removably attached at the apex of said reflector in such a manner that said base and said casing protrudes at the rear of said reflector, said protruding base and casing each contacting a different one of a pair of metal strips located in the bottom of said bowl when said lamp is positioned in said bowl.

9. An improved electrical swivel head hand lantern as defined in claim 7 wherein said means for swivelly securing said swivel head to said lantern handle comprises an insulated screw inserted inwardly through one of said prongs and one side of said lantern handle, said inserted insulated screw being secured to a conductive lamp cylinder inserted through the other of said prongs and the other side of said lantern handle, said lamp cylinder being internally screw threaded to receive said insulated screw, and when installed, said lamp cylinder and one of the portions of said metal strips attached to one of said prongs being conjoined.

10. An improved electrical swivel head hand lantern as defined in claim 9 wherein said means for electrically connecting said lamp comprises a first metal strip to which both said lamp cylinder and a first battery terminal are conjoined, and a second metal strip to which both said metal strip attached to said prong opposite said lamp cylinder and a second battery terminal post are conjoined.

11. An improved electrical swivel head hand lantern as defined in claim 10 wherein said first metal strip from said lamp cylinder to said first battery terminal post is run inside said lantern handle and said second metal strip is run at least partially inside said lantern handle.

12. An improved electrical swivel head hand lantern as defined in claim 10 wherein said switch means is a slide type switch located in said lantern handle and forming part of said first metal strip and operating so as to provide a means to break and restore the electrical connection between said lamp cylinder and said first battery terminal post.

13. An improved electrical swivel head hand lantern as defined in claim 12 wherein a flasher bulb is positioned in said lantern handle, in such a manner that the base of said flasher bulb contacts said first metal strip and the bulb casing contacts a third metal strip which is located inside said lantern handle and is conjoined with a switch means which permits contact with a conductive flasher cylinder mounted on said insulating screw opposite and separate from said lamp cylinder, said flasher cylinder being conjoined with said second metal strip.

* * * * *